US007422207B2

(12) United States Patent
Feijen

(10) Patent No.: US 7,422,207 B2
(45) Date of Patent: Sep. 9, 2008

(54) APPARATUS FOR TRANSPORTING SHEETS ALONG A TRANSPORT TRACK WITH A BEND PASSING AROUND A TRANSPORT ROLLER

(75) Inventor: Fransiscus Hermannus Feijen, Leeuwarden (NL)

(73) Assignee: NEOPOST Technologies, Bagneux (FR)

( * ) Notice: Subject to any disclaimer, the term of this patent is extended or adjusted under 35 U.S.C. 154(b) by 308 days.

(21) Appl. No.: 11/026,401

(22) Filed: Dec. 30, 2004

(65) Prior Publication Data

US 2005/0184445 A1 Aug. 25, 2005

(30) Foreign Application Priority Data

Dec. 31, 2003 (NL) ..... 1025159

(51) Int. Cl.
*B65H 29/00* (2006.01)

(52) U.S. Cl. ..... 271/184; 271/186; 271/198

(58) Field of Classification Search ..... 271/184, 271/185, 186, 215, 198
See application file for complete search history.

(56) References Cited

U.S. PATENT DOCUMENTS

| | | | | |
|---|---|---|---|---|
| 1,635,197 | A | | 7/1927 | Tufts |
| 1,706,843 | A | | 3/1929 | Dalton |
| 3,436,073 | A | * | 4/1969 | Newton ..... 271/186 |
| 3,659,699 | A | * | 5/1972 | Donahue et al. ..... 198/605 |
| 4,928,953 | A | | 5/1990 | Heina et al. ..... 271/185 |

FOREIGN PATENT DOCUMENTS

| | | |
|---|---|---|
| DE | 87411 | 7/1896 |
| DE | 1 960 543 | 10/1970 |
| DE | 31 34 862 A1 | 3/1983 |
| EP | 0 490 216 B1 | 12/1991 |
| EP | 0 896 938 A2 | 2/1999 |
| GB | 1162352 | 8/1969 |
| GB | 1401310 | 7/1975 |
| JP | 09-240929 | 9/1997 |
| WO | WO 02/072458 A2 | 9/2002 |

* cited by examiner

*Primary Examiner*—Kaitlin S Joerger
(74) *Attorney, Agent, or Firm*—Sughrue Mion, PLLC

(57) ABSTRACT

An apparatus for transporting sheets from paper or other material that is form-retaining in its plane, having a transport track with a transport roller with a circumference, of which a circumferential section extending through an angular range of the circumference forms a bend from a first track portion to a second track portion. At least one sheet guide has a sheet guiding surface facing the circumferential section, which sheet guiding surface extends coaxially with at least a portion of the circumferential section. At least the sheet guiding surface or the circumferential section is yieldably supported for yieldably urging towards each other the sheet guiding surface and the circumferential section.

14 Claims, 3 Drawing Sheets

APPARATUS FOR TRANSPORTING SHEETS ALONG A TRANSPORT TRACK WITH A BEND PASSING AROUND A TRANSPORT ROLLER

CROSS-REFERENCE TO RELATED APPLICATIONS

This application claims priority from Dutch Patent Application No. 1025159 filed on Dec. 31, 2003.

FIELD AND BACKGROUND OF THE INVENTION

This invention relates to an apparatus for transporting sheets, for instance from paper or other material that is form-retaining in its plane, along a transport track with a bend passing around a transport roller, between a first portion and a second, differently directed portion of the transport track.

It is known, for transporting sheets of paper around a bend, to use a sheet track, of which the bend passes through a particular angular range around a portion of the circumference of one or more transport rollers. For guiding the individual sheets or stacked sheets around the bend, a sheet guiding surface can be used which is situated within the angular range at a small, constant distance from the circumferential portion of the transport roller. A drawback of such a sheet track is that it is only suitable for transporting sheets or stacked sets of sheets having a thickness within a narrow range. When sheets are too thin, they are not reliably passed through, and if a set is too thin, moreover, different sheets pass around the bend along arcs having relatively greatly different radii—and hence along paths of relatively greatly different lengths—which gives rise to mutual shifting of the sheets. If a sheet or set of sheets is too thick, it will jam or at least there is a considerable risk it will jam.

It is also known, for guiding sheets or stacked sets of sheets around the bend, to use sheet guiding rollers circumferentially distributed over the angular range, each defining a nip with the transport roller against which they abut. In operation, the paper is then guided through the bend in that it is guided through the series of successive nips between the circumferential section and the rollers cooperating with it. A drawback of this construction, however, is that it is complex and costly. A further drawback is that each time when stacked sets of sheets are being guided through the nip, the outer sheets, and especially the sheets on the side of the relatively small rollers, are displaced, with respect to the other sheets, against the transport direction. Such small displacements add up to mutually displaced sheets which, in particular if the sheets are subsequently folded, give the set of sheets a sloppy appearance.

SUMMARY OF THE INVENTION

It is an object of the invention to make it possible, with a simple construction, to guide both single sheets and stacked sets of sheets around a bend, and to prevent mutual shifting of the sheets in the transport direction. This object is achieved according to the invention by providing an apparatus for transporting sheets from paper or other material that is form-retaining in its plane, comprising:

a transport track with a first track portion extending in a first direction and a second track portion downstream of the first track portion, extending in a second direction other than the first direction;

at least one transport roller with a circumference, of which a circumferential section extending through an angular range of the circumference forms a bend from the first track portion to the second track portion; and at least one sheet guide with a sheet guiding surface facing the circumferential section, which sheet guiding surface extends coaxially with at least a portion of the circumferential section;

wherein at least the sheet guiding surface or the circumferential section is yieldably supported for yieldably urging towards each other the sheet guiding surface and the circumferential section for exerting normal force on sheet material between the sheet guiding surface and the circumferential section.

Owing to the sheet guiding surface, which faces the circumferential section and extends coaxially with at least a portion of the circumferential section, and the circumferential section being urged towards each other elastically or yieldably in a different manner, for exerting normal force on the sheet or the sheets between the sheet guiding surface and the circumferential section, single sheets and stacked sets of sheets of greatly different thickness can be guided around the bend, without necessitating a complex, costly construction for that purpose. The sheet guide, which yields as a result of normal force exerted on it by a set of sheets between the transport rollers and the sheet guiding surface, and thereby moves away from the transport rollers, exerts on the passing sheets a normal force which is circumferentially distributed over a great length, so that the pressure exerted on the sheets is relatively low and mutual shifting of the sheets, such as caused by a succession of pressure peaks at successive nips between rollers, is prevented or at least limited.

Further features and aspects of the invention are set forth in the dependent claims and are apparent from the following description of exemplary embodiments represented in the drawing, in which description, furthermore, further effects and details of the invention are set forth.

DETAILED DESCRIPTION

Figure 1:
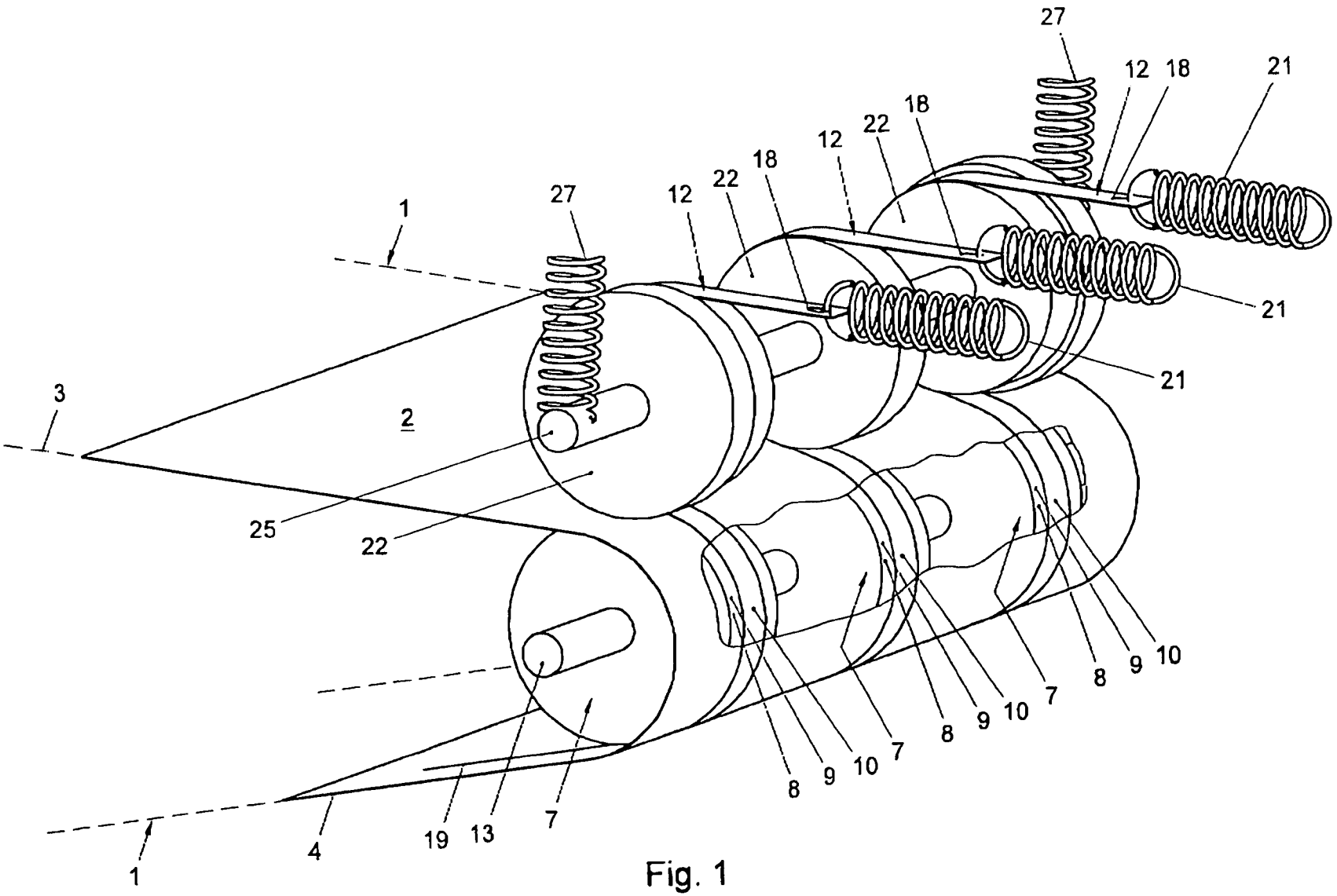
FIG. 1 is a schematic perspective view of an example of an apparatus according to the invention.
Figure 2:
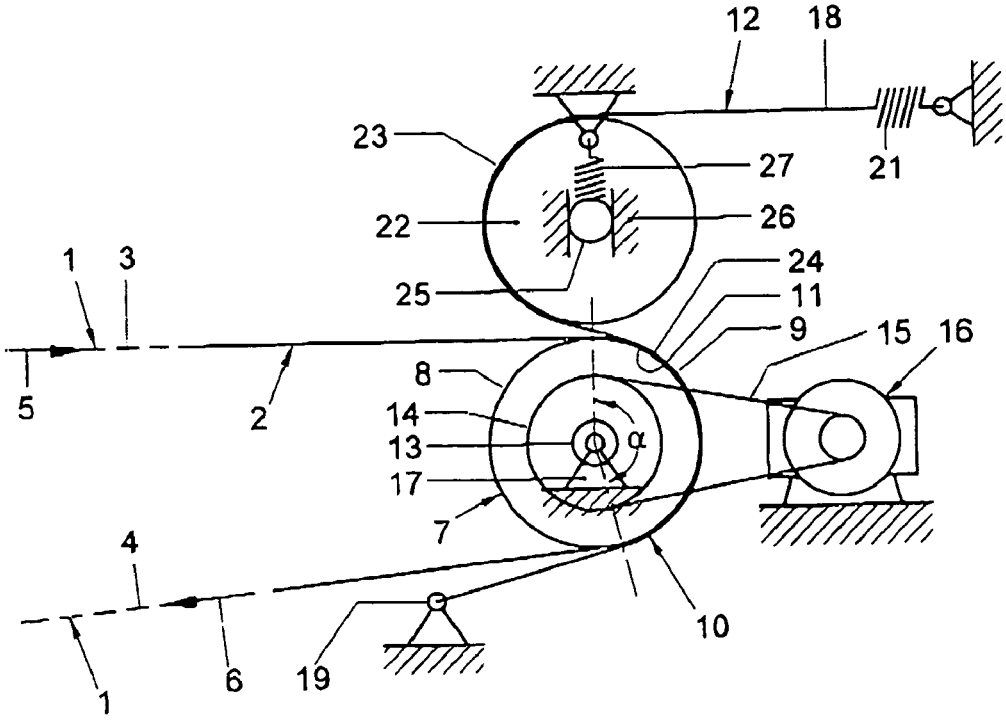
FIG. 2 is a schematic, side elevational representation of the apparatus according to FIG. 1.

The apparatus according to the exemplary embodiment represented in FIGS. 1 and 2 constitutes the presently most preferred embodiment of the invention.

The apparatus is intended for transporting sheets 2 from paper, or other material that is form-retaining in its plane, along a transport track 1 with a first track portion 3 which extends in a first direction (arrow 5) and a second track portion 4, downstream of the first track portion 3, which extends in a second direction (arrow 6), deviating from the first direction 5. According to this example, the angle between the first direction and the second direction is slightly less than 180°, but also other angles, much smaller than, equal to or greater than 180°, are possible options, such as, for instance, angles of 30°, 45°, 90° and 180°.

According to this example, the apparatus is further equipped with transport rollers 7. The transport rollers 7 each have a circumference 8. Through an angular range $\alpha$ (see FIG.

2) of the circumference 8 extends a circumferential section 9 which forms a bend from the first track portion 3 to the second track portion 4. The transport rollers 7 are mounted on a common shaft 13 which is rotatably bearing-mounted in a housing frame (schematically represented in FIG. 2 as a fixed support 17). Also mounted on the shaft 13 is a transmission pulley 14, which can drive the transport rollers via the shaft 13. The pulley 14 is drivable by a motor 16 via a rope 15. The transport rollers 7 are thus coupled with a drive for driving rotation of the transport rollers 7 about their axis. The drive of the transport rollers can be constructed in many ways which may or may not be known per se. It is also possible that the transport rollers are not driven, but, for instance, are bearing-mounted so as to be freely rotatable, while rotation of the transport rollers is realized in that they are carried along, for instance through the rotation of press-on rollers abutting against them, which roll over a sheet as it passes.

The sheets 2 to be transported are on the one hand bending-stiff but on the other hand so flexible and elastically deformable as to permit transport around the bend without undergoing any essential permanent bending. In general, the sheets are manufactured from materials, such as paper and plastic, that have a bending modulus of $10^3$-$10^4$ N/mm$^2$, and they each have a thickness of between 0.05 and 0.25 mm.

The apparatus is further equipped with sheet guides 10 each having a sheet guiding surface 11 (see FIG. 2) facing the circumferential section 9 of the associated transport roller 7, which surface 11 extends coaxially with an opposite portion of the circumferential section 9. The sheet guiding surfaces 11 are each yieldably supported for elastically urging towards each other the sheet guiding surface 11 and the circumferential section 9 for exerting normal force on sheet material 2 between the sheet guiding surface 11 and the circumferential section 9.

In operation, the sheet guiding surfaces 11 and the circumferential section 9, which extend coaxially, are urged elastically towards each other for exerting normal force on the sheet 2 or the sheets 2 between the sheet guiding surfaces 11 on the one hand and the circumferential sections 9 on the other hand. The mutual displaceability of the sheet guiding surfaces 11 on the one hand and the circumferential sections 9 on the other hand which are urged towards each other with a tensile force makes it possible to pass single sheets and stacked sets of sheets of greatly different thicknesses around the bend, without necessitating a complex, costly construction and/or setting provisions. On the passing sheets 2, a normal force is then exerted, which is distributed in a circumferential sense over a great length, so that the maximum pressure that is exerted on the sheets remains relatively low. Mutual shifting of the sheets, such as caused by a succession of pressure peaks at successive nips between rollers is thus prevented or at least limited.

In the apparatus according to this example, further, the sheet guiding surface 11 is formed by a surface of a flexible strip 12. Consequently, the sheet guiding surface 11 is elastically deformable and hence conformable depending on the shape of sheets 2 passing between the rollers 7 and the sheet guiding surface 11. Owing to the sheet guiding surface 11 being elastically conformable, it can conform closely to the shape of the circumferential section 9 of the associated roller 7, without this requiring that particularly narrow tolerances be used at manufacture. By virtue of this close conformity, also very thin sheets can be reliably passed through. What is prevented, moreover, is the leading edge deviating away from the roller, which is a cause of displacements of documents in the transport direction. A further advantage of the elastic conformability is that, also when feeding through thick sheets or thick sets consisting of several sheets, even when they are of unequal length, a uniform pressure distribution is obtained without high maximum pressures that can lead to shifting of sheets or to traces being left on the sheets.

Although it would be possible to design the sheet guides as surfaces moving along with the roller, for instance by designing them in the form of circulating belts, it is preferred, in transport direction, leaving aside small back-and-forth movements upon accommodation to passing sheets, to use stationary sheet guides. These are constructionally simpler to realize, the friction force, unlike in the case of force exerted by elements moving along, is not essentially influenced by mass inertia of the sheet guide(s) and no account needs to be taken of the force exerted against the transport direction, caused by the resistance of an endless, circulating element. For a reliable transport of sets of stacked sheets, it is sufficient to ensure that the friction between the sheets mutually is greater than the friction between the outer sheet and the sheet guiding surfaces.

That the sheet guides 10 are each designed, at least in an area opposite the circumferential section 9 of the associated transport roller 7, as a flexible strip 12 further offers the intrinsic advantage that the sheet guides are of simple construction, take up little space and have a small mass, so that in reaction to the passage of sheets 2 they can yield fast without this entailing any great reaction forces.

The exertion of the normal forces with which the sheet guides 10 are urged to the transport rollers 7 has been realized in a simple manner, in that the flexible strips 12 have been tensioned around the associated transport rollers 7 over at least a portion of the angular range $\alpha$.

A further particular feature of the apparatus according to this example is that the sheet guiding surfaces 11 in a rest position each abut against the associated circumferential section 9. Consequently, also without a very accurate control of the minimal distance between the sheet guiding surfaces 11 and the associated circumferential sections 9, a very reliable transport of very thin sheets as well can be realized.

In the apparatus according to this example, the sheet guiding surfaces 11 are each supported such that in reaction to a friction force directed downstream in the circumferential sense of the circumferential section 9, exerted on the sheet guiding surface 11, the normal force exerted by the sheet guiding surface 11, directed towards the circumferential section 9, is reduced. What is thus achieved is that the sheet guiding surfaces 11 are not pulled tight onto the transport roller 7 by friction forces exerted thereon. As the friction forces result in a reduction of the normal force, in each case, also when a thick set of sheets 2 passes between the transport rollers 7 and the sheet guiding surfaces 11, an equilibrium is established whereby the normal force and hence the friction force remains relatively low. If a set of sheets passes between the sheet guiding surfaces 11 and the transport rollers, the normal forces exerted by the sheet guiding surfaces 11 are partly dependent on the coefficient of friction between the outer sheet and the sheet guiding surfaces 11. As a consequence, smooth sheets are pressed-on slightly harder than rough sheets. Further, this can prevent a strong increase of the friction occurring if the sheet guiding surfaces 11 abut directly against the relatively rough transport rollers 7 or if a relatively thick set of sheets urges the sheet guides 10 relatively far away from the transport rollers 7, against the elastically exerted normal forces.

The flexible strips 12 are each tensioned between an upstream point of engagement 18 elastic in the direction of the respective strip 12, and a downstream point of engagement 19. In reaction to downstream directed friction force exerted on the flexible strips, the upstream points of engagement 18 yield elastically and the downstream points of engagement 19, at least in the direction of the strips 12 adjacent those downstream points of engagement 19, do not yield. Reduction of the normal forces in reaction to friction forces has thus been realized in a simple manner. Owing to the downstream points of engagement constituting supports of the strips 12 against their being carried along in the direction of rotation of the transport rollers 7, what is prevented is that the strips 12 are carried along by the transport rollers 7 as a result of a twisting effect, similarly to a line twisted onto a winch. The downstream points of engagement 19 are preferably situated at substantially fixed places with respect to the housing, but may also be suspended elastically, or otherwise yieldably, for supporting the downstream directed friction forces for a smaller part. According to this example, the yieldable suspension of the upstream points of engagement 18 has been realized in that between the respective parts 20 of the housing and the upstream points of engagement 18, draw springs 21 have been arranged, which keep the strips 12 tensioned.

For easy inspection, cleaning and service of the paper track, as well as for easy removal of sheets from it, it is important that the paper track 1 be well accessible. For a smooth guidance of the sheets 2, by contrast, a gradual convergence of the outer circumferences of the transport rollers 7 and the strips 12 is advantageous. In the apparatus according to this example, a good accessibility has been combined with a gradual convergence as described, by the provision of strip guides 22, situated at and opposite to upstream portions of the circumferential sections 9, the strips 12 each having a first portion 23, which is curved oppositely to a second portion 24 extending along the associated circumferential section 9, and which merges with the upstream side of that second portion 24 and is supported against the strip guide 22. According to this example, the strip guides 22 are designed as rollers 22 which are rotatably suspended by means of a shaft 25.

The shaft 25 with rollers 22 fixedly mounted thereon may be rotatably suspended and/or the rollers 22 may be rotatably bearing-mounted on the shaft 25. It is also possible to make the outer circumference of the strip guides 22 so smooth and wear resistant that the strips 12 slide over them when a set of sheets 2 passing between the strips 12 and the transport rollers 7 causes the strips 12 to move away from the transport rollers 7.

For elastically urging the strips 12 to the transport rollers 7, springs 21 are provided which keep the strips 12 under tension. According to this example, the springs are designed as helical springs 21 under strain of tension, but the springs may also be designed differently and be formed, for instance, by suitably shaped portions of the strips. These can for instance be designed with one or more bends, preferably in the plane of rotation of the transport rollers 7.

For yieldably urging the sheet guiding surfaces to the transport rollers, instead of elastic parts or elastic portions thereof, other solutions may be used, such as urging the sheet guiding surfaces towards the transport rollers by means of gravity, centrifugal force or slipping friction force.

The flexible strips preferably have some bending stiffness. By manufacturing the strips 12 from strip steel or plastic, strips can be obtained that are flexible to a suitable extent and yet are sufficiently bending-stiff.

The shaft 25 carrying the strip guiding rollers 22 is movably suspended in a guide 26 which enables to-and-fro movement of the shaft 25 to the transport rollers 7 and away from them. The shaft is yieldably urged to the transport rollers 7 by springs 27. This yielding force exertion can also be exerted in a different manner than elastically, for instance as a reaction force resulting from friction, by centrifugal force or by gravity.

Figure 3:
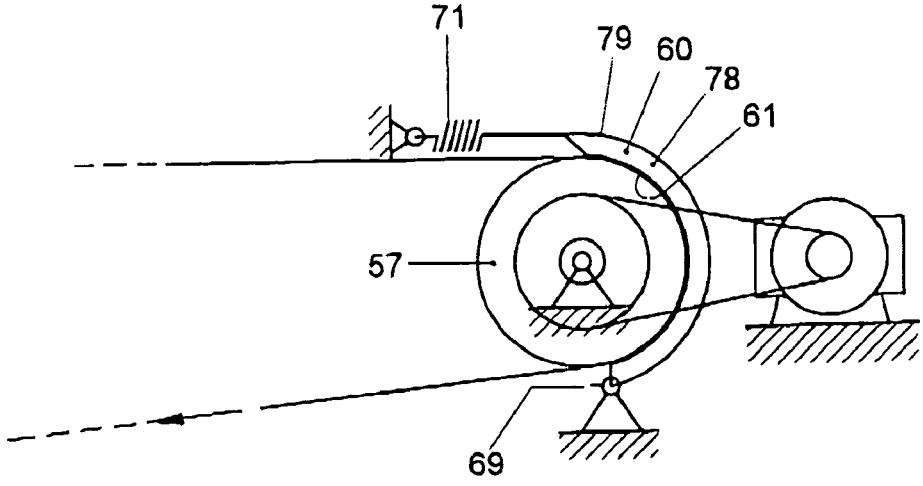
FIGS. 3-5 are representations in side elevation of apparatuses according to a second, third and fourth exemplary embodiment of the invention.

In FIG. 3 a second exemplary embodiment of an apparatus according to the invention is represented, in which the sheet guides 60 are designed with a compressible layer 78 carried by a bending-stiff bracket 79. Thus, in a different manner than in the example described above, a suitable extent of dimensional stability is combined with a suitable extent of conformability of the sheet guiding surface 61.

According to this example, the spring member 71 engages the sheet guide 60 at a point of engagement 79 adjacent the upstream end of the sheet guiding surface 61, and downstream of the sheet guiding surface 61 the sheet guide 60 is fixedly suspended. Also possible is an adjustable and/or yielding suspension of the sheet guide 60 downstream of the sheet guiding surface 61. It is then preferred that the yieldability and the permitted freedom of movement of sheet guide 60 is such that friction force directed downstream and in circumferential direction, exerted on the sheet guiding surface 61, causes the normal force with which the sheet guiding surface 61 is urged to the transport roller 57 to be reduced.

Figure 4:
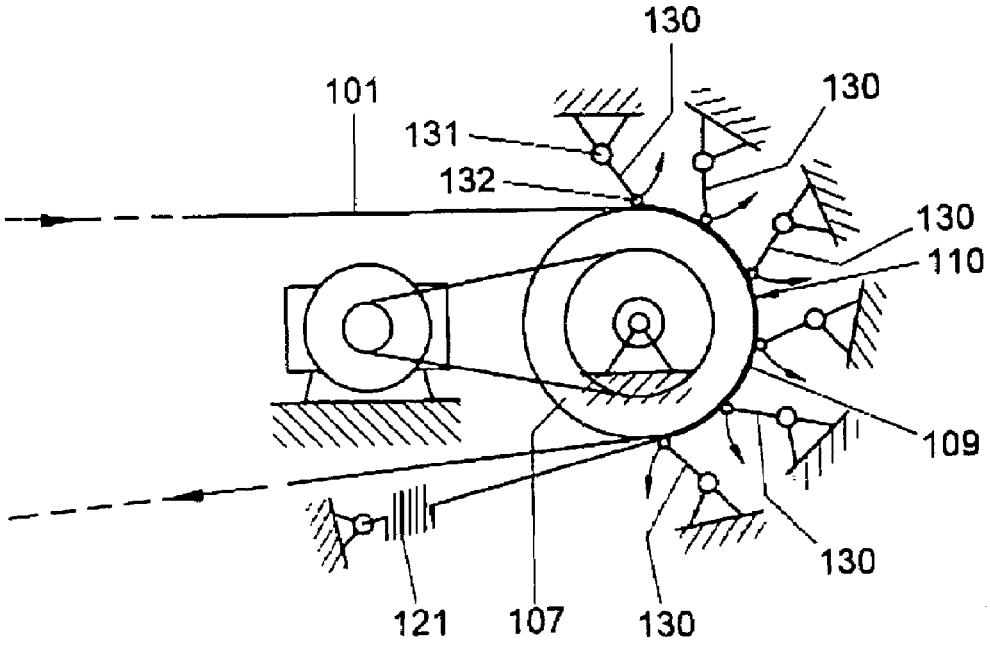

FIG. 4 shows a third example of an apparatus according to the invention. According to this exemplary embodiment, the sheet guide 110 is designed as a flexible sliding shoe. The sheet guide 110 is carried by a number of supporting arms 130 which are circumferentially distributed along the circumferential section 109 defining the bend in the paper track 101. The arms 130 each form a connection between two hinging points of engagement 131 and 132 of the housing and the sheet guide 110, respectively. The angle of the line of action through the points of engagement 131, 132 in each case is such that displacement in downstream circumferential direction around the transport roller 107 of the point of engagement 132 which is part of the sheet guide 110 results in a displacement of the sheet guide 110 in the area of that point of engagement 132 away from the transport roller 107. The sheet guide 110, however, is urged in upstream direction by a compression spring 121, so that the sheet guide 110 is yieldably urged to the transport roller 107 also by the arms 130. Instead of the compression spring 130, a different elastic or otherwise yieldable element can be used for yieldably urging the sheet guide in upstream direction. When in operation the friction force in downstream circumferential direction that is exerted on the sheet guide 110 increases, the normal force with which the sheet guide 110 is urged to the transport roller 107 decreases.

Figure 5:
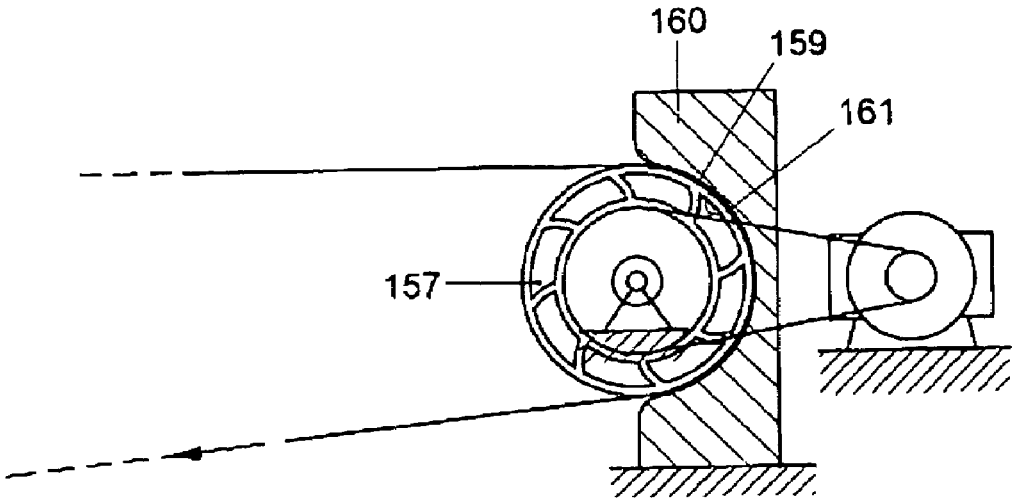

Instead of or in addition to the sheet guiding surface, also the circumferential surface of the transport roller may be yieldable and optionally, at least in the area of the circumferential section opposite the sheet guiding surface, be elastically conformable. This is illustrated with the example represented in FIG. 5.

According to this example, the sheet guide 160 is designed as a rigid element with a rigid sheet guiding surface 161 at a fixed position relative to the frame and/or the housing of the apparatus. It is noted, however, that in combination with a yielding transport roller, for instance a transport roller 157 as represented in this example, the sheet guide may also be of yielding design, for instance as is represented in the above-described examples.

The circumference of the transport roller 157 is supported by the spokes which, viewed radially outwards, operatively extend rearwards relative to the sense of rotation, in such a manner that in reaction to a friction force exerted in a circumferential sense in upstream direction on the circumferential section, normal force exerted by the circumferential section 159 opposite the sheet guiding surface 161, directed to the sheet guiding surface 161, is reduced. In this way too, a smooth running-in of sets of sheets of greatly different thicknesses is combined with an accurate guidance, without undue normal forces being exerted on the sets of sheets.

The invention claimed is:

1. An apparatus for transporting sheets from paper or other material that is form-retaining in its plane, comprising:

a transport track with a first track portion extending in a first direction and a second track portion downstream of the first track portion, extending in a second direction other than the first direction;

at least one transport roller with a circumference, of which a circumferential section extending through an angular range of the circumference forms a bend from the first track portion to the second track portion; and at least one sheet guide with a sheet guiding surface facing the circumferential section, which sheet guiding surface extends coaxially with at least a portion of the circumferential section, the sheet guide being tensioned between an upstream point of engagement and a downstream point of engagement, where the sheet guide is mounted to the downstream point of engagement such that, in operation, at the downstream point of engagement, the sheet guide is stationary in the direction of the at least one sheet guide;

wherein at least the sheet guiding surface or the circumferential section is yieldably supported for yieldably urging towards each other the sheet guiding surface and the circumferential section for exerting normal force on sheet material between the sheet guiding surface and the circumferential section; and wherein the circumferential section is supported such that in reaction to a friction force directed upstream in the circumferential sense of the circumferential section, exerted on the circumferential section, normal force exerted by the circumferential section, directed to the sheet guiding surface, is reduced.

2. An apparatus according to claim 1, wherein at least the circumferential section or the sheet guiding surface is elastically conformable.

3. An apparatus according to claim 1, wherein the sheet guiding surface in rest condition abuts against the circumferential section.

4. An apparatus according to claim 1, wherein the sheet guide comprises at least one flexible strip, which extends along the circumferential section.

5. An apparatus according to claim 4, wherein the at least one flexible strip is tensioned around the at least one transport roller through at least a portion of said angular range.

6. An apparatus according to claim 5, further comprising at least one strip guide adjacent and opposite an upstream portion of the circumferential section, the flexible strip having a first portion which is curved oppositely to a second portion extending along the circumferential section, and merges with the upstream side of said second portion of the flexible strip and is at least locally supported against the strip guide.

7. An apparatus according to claim 6, further comprising a spring for elastically urging the strip guide to the at least one transport roller.

8. An apparatus according to claim 6, wherein the at least one strip guide is designed as a roller bearing-mounted with an axis of rotation parallel to the centerline of the at least on transport roller.

9. An apparatus according to claim 5, wherein the flexible strip is a strip from strip steel or plastic.

10. An apparatus for transporting sheets from paper or other material that is form-retaining in its plane, comprising:

a transport track with a first track portion extending in a first direction and a second track portion downstream of the first track portion, extending in a second direction other than the first direction;

at least one transport roller with a circumference, of which a circumferential section extending through an angular range of the circumference forms a bend from the first track portion to the second track portion; and at least one sheet guide with a sheet guiding surface facing the circumferential section, which sheet guiding surface extends coaxially with at least a portion of the circumferential section;

wherein at least the sheet guiding surface or the circumferential section is yieldably supported for yieldably urging towards each other the sheet guiding surface and the circumferential section for exerting normal force on sheet material between the sheet guiding surface and the circumferential section; and wherein the sheet guiding surface is supported such that in reaction to a friction force directed downstream in the circumferential sense of the circumferential section, exerted on the sheet guiding surface, normal force exerted by the sheet guiding surface, directed to the circumferential section, is reduced.

11. An apparatus for transporting sheets from paper or other material that is form-retaining in its place, comprising:

a transport track with a first track portion extending in a first direction and a second track portion downstream of the first track portion, extending in a second direction other than the first direction;

at least one transport roller with a circumference, of which a circumferential section extending through an angular range of the circumference forms a bend from the first track portion to the second track portion; and at least one sheet guide with a sheet guiding surface facing the circumferential section, which sheet guiding surface extends coaxially with at least a portion of the circumferential section;

wherein at least the sheet guiding surface or the circumferential section is yieldably supported for yieldably urging towards each other the sheet guiding surface and the circumferential section for exerting normal force on sheet material between the sheet guiding surface and the circumferential section;

wherein the sheet guide comprises at least one flexible strip, which extends along the circumferential section; and wherein the at least one flexible strip is tensioned between at least one upstream point of engagement elastic in the direction of the strip, and a downstream point of engagement, the upstream point of engagement being arranged for yielding in reaction to downstream directed friction force exerted on the at least one flexible strip, and the downstream point of engagement being arranged for at least partly supporting the downstream directed friction force, such that in reaction to friction force directed downstream in the circumferential sense of the circumferential section, exerted on the at least one flexible strip, normal forces exerted by the at least one flexible strip and directed to the circumferential section are reduced.

12. An apparatus for transporting sheets from paper or other material that is form-retaining in its plane, comprising:

a transport track with a first track portion extending in a first direction and a second track portion downstream of the first track portion, extending in a second direction other than the first direction;

at least one transport roller with a circumference, of which a circumferential section extending through an angular range of the circumference forms a bend from the first track portion to the second track portion; and at least one sheet guide with a sheet guiding surface facing the circumferential section, which sheet guiding surface extends coaxially with at least a portion of the circumferential section, the sheet guide being tensioned between an upstream point of engagement and a downstream point of engagement, where the sheet guide is mounted to the downstream point of engagement such that, in operation, at the downstream point of engagement, the sheet guide is stationary in the direction of the at least one sheet guide;

wherein at least the sheet guiding surface or the circumferential section is yieldably supported for yieldably urging towards each other the sheet guiding surface and the circumferential section for exerting normal force on sheet material between the sheet guiding surface and the circumferential section;

wherein the sheet guide comprises at least one flexible strip, which extends along the circumferential section;

wherein the at least one flexible strip is tensioned around the at least one transport roller through at least a portion of said angular range; and further comprising at least one strip guide adjacent and opposite an upstream portion of the circumferential section, the flexible strip having a first portion which is curved oppositely to a second portion extending along the circumferential section, and merges with the upstream side of said second portion of the flexible strip and is at least locally supported against the strip guide.

13. The apparatus of claim 12, further comprising a spring for elastically urging the strip guide to the at least one transport roller.

14. The apparatus according to claim 12, wherein the at least one strip guide is designed as a roller bearing-mounted with an axis of rotation parallel to the centerline of the at least on transport roller.

* * * * *